United States Patent [19]

Rothermel et al.

[11] Patent Number: 4,534,465

[45] Date of Patent: Aug. 13, 1985

[54] CASSETTE FOR SUPPORTING TEST TUBES OF DIFFERENT DIAMETERS AND/OR LENGTHS

[75] Inventors: William F. Rothermel, Hollywood; John P. Matthews, Pembroke Pines; James W. Walker; Wallace H. Coulter, both of Miami Springs, all of Fla.

[73] Assignee: Coulter Electronics, Inc., Hialeah, Fla.

[21] Appl. No.: 541,602

[22] Filed: Oct. 13, 1983

[51] Int. Cl.[3] ..... B65D 81/30

[52] U.S. Cl. ..... 206/443; 206/3; 206/485; 211/74; 422/104

[58] Field of Search ..... 206/3, 241, 379, 443, 206/445, 446, 484, 485; 24/10 R, 11 FE, 11 F, 11 P; 211/69, 74; 422/102, 104

[56] References Cited

U.S. PATENT DOCUMENTS

| | | | |
|---|---|---|---|
| 2,438,895 | 4/1948 | Bouffard et al. | 206/214 |
| 2,812,563 | 11/1957 | Barber | 24/10 R |
| 2,990,945 | 7/1961 | Smith | 206/3 |
| 3,153,500 | 10/1964 | Pachmayr et al. | 206/3 |
| 3,388,807 | 6/1968 | Emmitt | 206/443 |
| 3,616,976 | 11/1971 | Geretschlaeger | 206/3 |
| 3,643,812 | 2/1972 | Mander et al. | 206/443 |
| 3,905,482 | 9/1975 | Knulst | 211/74 |
| 4,124,122 | 11/1978 | Emmitt | 211/74 |
| 4,142,633 | 3/1979 | Raghavachari et al. | 206/443 |
| 4,181,220 | 1/1980 | Zicko | 206/443 |
| 4,189,048 | 2/1980 | Gaillard | 24/10 R |
| 4,434,890 | 3/1984 | Sieck et al. | 206/443 |

FOREIGN PATENT DOCUMENTS

| | | | |
|---|---|---|---|
| 293212 | 7/1965 | Netherlands | 206/485 |
| 1344511 | 1/1974 | United Kingdom | 206/443 |

*Primary Examiner*—Joseph Man-Fu Moy
*Assistant Examiner*—David T. Fidei
*Attorney, Agent, or Firm*—Stephen A. Roen; Gerald R. Hibnick

[57] ABSTRACT

A stackable cassette or rack for supporting a plurality of sealed sample containers having different diameters and/or lengths and transporting the same to a testing station of a hematology analyzer device. The cassette comprises a body having a top and a bottom and a rear portion, and the body includes a base, front and intermediate walls and a biasing means, connected between the front and intermediate walls, both walls longitudinally extend across the base and each wall has a plurality of equidistantly spaced openings therein arranged in a row lengthwise of the cassette which openings extend from the base to the top of the body. Each of the openings in the front wall has an upper edge and the spaced apart holes of both walls are in alignment. The biasing means are connected to the bottom of the body to provide secure and proper positioning for all sample containers inserted through the spaced openings in the front and intermediate walls and so that their upper walls abut against the upper edges of the openings in the front wall, the later to facilitate accurate optical reading of information placed on their upper wall surfaces. The biasing means also maintains a parallel orientation between the longitudinal axis' of the inserted sample containers and their receptacles. Further included is a plurality of equidistantly spaced channels arranged in a row lengthwise of the cassette and extending from the base to the top of the body and from the intermediate wall to the end of the rear portion of the body and open ended thereat and arranged so as to permit entry of a rod member.

13 Claims, 8 Drawing Figures

CASSETTE FOR SUPPORTING TEST TUBES OF DIFFERENT DIAMETERS AND/OR LENGTHS

BACKGROUND OF THE INVENTION

This invention relates to a stackable cassette for supporting a plurality of sample containers, such as test tubes, having different diameters and/or lengths and transporting them to a testing or sample aspiration station. More particularly, the invention concerns the transportation and identification of sealed test tubes having different diameters and lengths in a hematology analyzer of the type which heretofore required the manual introduction of a blood sample held in vertically oriented, open-mouthed containers of the same size. Full automation is accomplished by being able to utilize, in the same cassette, test tubes of varying sizes containing blood samples. Such a cassette obviates the requirement of first having to manually remove and transfer the blood samples in those containers which are not adapted to be received properly in the receptacle/s of a cassette which is only designed to properly receive test tubes of one size. It also obviates the requirement of providing a plurality of different cassettes each of which is capable of properly receiving test tubes of one of the differing sizes of test tubes expected to be received in a hematology laboratory together with a hematology analyzer which is compatible with such plurality of different cassettes. Such full automation is practical only in an optimized system which utilizes the same cassettes to receive blood samples in tubes of serveral different diameters and/or lengths and which is fully capable of sequentially receiving them even though randomly placed in the cassette, it being a given that it is common practice to collect blood samples in tubes having several different lengths and/or diameters.

Automatically operated transporter apparatus for sequentially performing aspirating functions on a plurality of substantially vertically oriented, open-mouthed test tubes containing blood samples which tubes are arranged in staggered positions in two columns in a common rack and which tubes are alternately titled under an aspirating tip is taught in U.S. Pat. No. 3,768,526, Automatic Test Tube Transporter and Sample Dispenser, issued Oct. 30, 1973, to Sanz et al. Sanz et al states:

> "Referring now to FIG. 5 there is shown a cross-section of the rack 200. The test tubes 207′ are shown received in the racks and are normally biased upright by a spring 222 held against the back wall 205. Spring 222 maintains resilient pressure on tube 207′. As post 124 passes through slots 215 and encounters the walls of the test tubes, it pushes them and they tilt into the position shown in FIG. 5.
>
> Part of the wiper and tip mechanism 600 is shown in FIG. 5 and the device is so arranged that the tip 618 hits the inner wall of test tube 207′ at point X. This is important since if the aspiration and dispensing do not take place along this inner side splashing occurs which is not desired due to loss of liquid, agitation and bubble formation.
>
> When a smaller test tube is used it is desirious to have the tip hit the inner wall thereof at approximately the same point. In these cases an adaptor block 220 is used (FIG. 6). The block is shaped similar to test tube 207 so that it will tilt in the same manner. The smaller tube is received in a bore 221 of smaller diameter than adaptor 220. Adaptor 220 also has a projection 224 which is adapted to fit into notch 207. This is to insure that the smaller test tube is in proper orientation for the tip 618 to be received therein.
>
> It should be noted that the taper 208 of hole 206 and the elliptical shape and taper 210 of holes 209 accommodate the tilting of test tube 207′.
>
> In the embodiments of the rack shown in FIGS. 5 and 6 the member 204′ has recessed areas 212′ which act in the same manner as slots 212." (column 4, line 44 to column 6, line 6).

This apparatus' loading and transporting procedure and mode, respectively, suffer from the obvious drawbacks inherent in having the sample test tubes open to atmosphere at all times, as well as requiring additional manual handling to place smaller test tubes in adaptor blocks having the proper sized receptacle therein, and the further requirement that sealed test tubes have their sealing stoppers manually removed prior to usage therein. The later requirement presents additional problems, since the opening of the whole blood container, which typically is under a small vacuum by virtue of the blood collecting technique, permits an aerosol to escape into the laboratory close to the technician who is operating the system. Such aerosol can contain blood related impurities and transmit disease, such as hepatitis. Furthermore, the apparatus and its racks do not provide for sample mixing nor are the racks themselves suitable for mixing particularly as their containers are open-mouthed and designed to be tilted within the stationary rack. Additionally, the two column staggered, substantially vertical, positional design requirement of the rack and the apparatus' requirement of open-mouthed containers are inherent limitations which do not easily lend themselves to utilization in a fully automated hematology analyzer of the type that this cassette's inventive design permits.

SUMMARY OF THE INVENTION

The invention, in its broadest aspects, includes a cassette for supporting a plurality of sealed sample containers having different diameters and/or lengths and transporting the same to a testing station of an analytical device, and comprises a body having a top and a bottom and a rear portion. The body includes a base and a front wall longitudinally extending across said base. The front wall has a plurality of equidistantly spaced openings therein arranged in a row lengthwise of the cassette and extending from the base to the top of the body, and each of said openings has an upper edge. The body further includes an intermediate wall, spaced from said rear portion of said body, longitudinally extending across said base, and has a plurality of equidistantly spaced openings therein arranged in a row lengthwise of the cassette and extending from the base to the top of the body, individual ones of said spaced openings of said front and intermediate wall being in opposed, aligned, and spaced apart relationship. The body additionally includes biasing means, connected between said front and intermediate walls and to the bottom of said body, for positioning all said plurality of sample containers inserted through said spaced openings of said front and intermediate walls against the upper edges of said spaced openings of said front wall. The biasing means also securely maintains them in their receptacles as well as maintaining a parallel orientation between the longitudinal axis' of the inserted sample containers and their receptacles. In a narrower aspect thereof, the body further includes a plurality of equidistantly spaced channels arranged in a row lengthwise of the cassette and extending from the base to the top of the body and from said intermediate wall to the end of the rear portion of said body and open ended thereat and arranged to permit entry of a rod member.

BRIEF DESCRIPTION OF THE DRAWINGS

FIG. 1 is a top elevation view of the cassette of the present invention shown with two sample containers of different sizes and with several biasing means shown in phantom lines;

DETAILED DESCRIPTION OF THE INVENTION

Figures 2, 3, 4, 7:
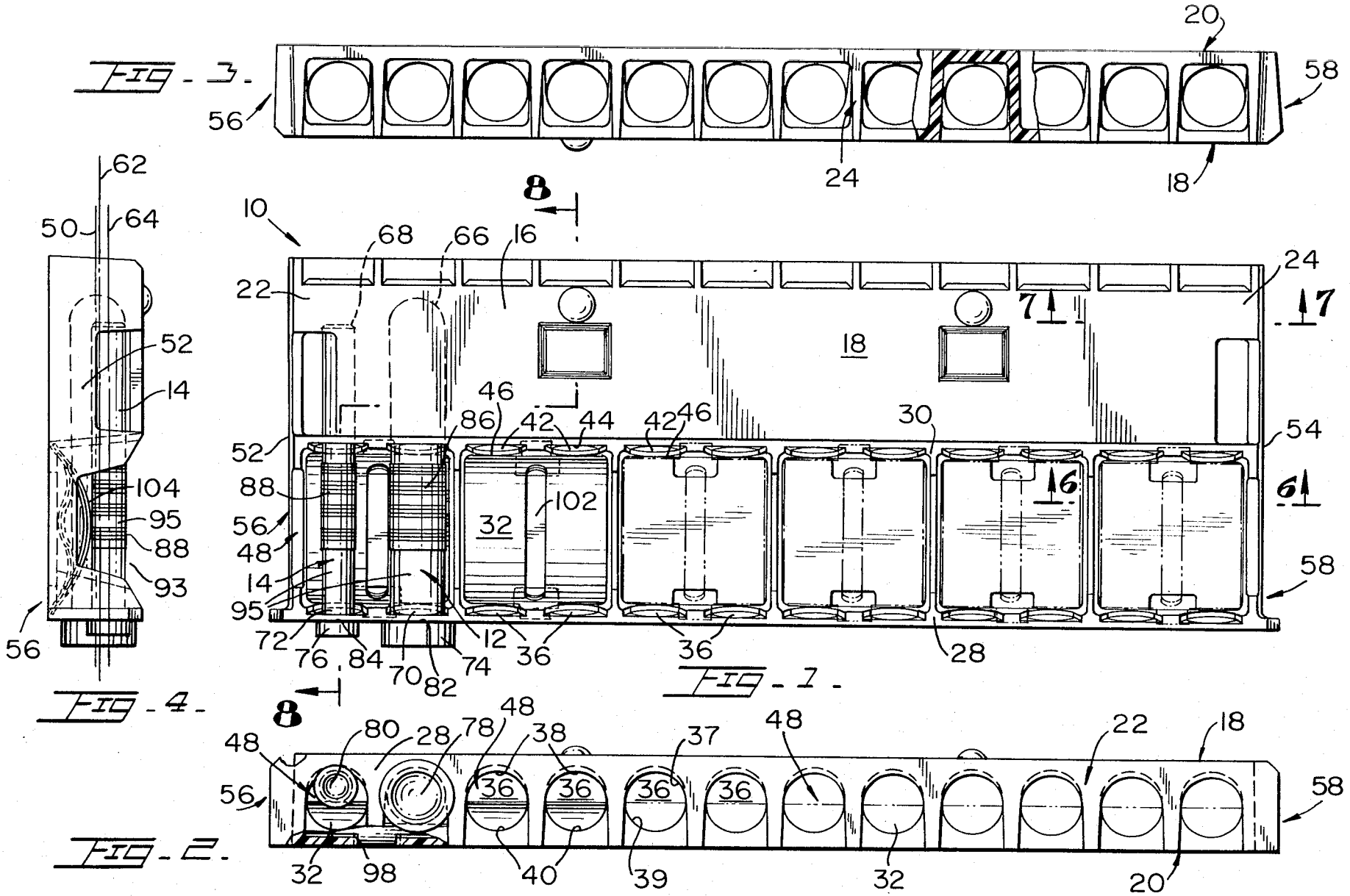
FIG. 2 is a front side elevation view of the cassette of FIG. 1, a portion of which is partially broken away to show a slot for the biasing means.
FIG. 3 is a rear side elevation view of the cassette of FIG. 1, a portion of which is partially broken away to show one of its channels.
FIG. 4 is a front end elvation view of the cassette of FIG. 1, particularly showing the maintenance of a parallel orientation between the longitudinal axes' of a small test tube and its receptacle and with portions of this small test tube and the large test tube behind it and their common biasing means shown in phantom lines.
FIG. 7 is a fragmentary sectional view of the cassette of FIG. 1, taken along 7—7 of FIG. 1.
Figure 5:
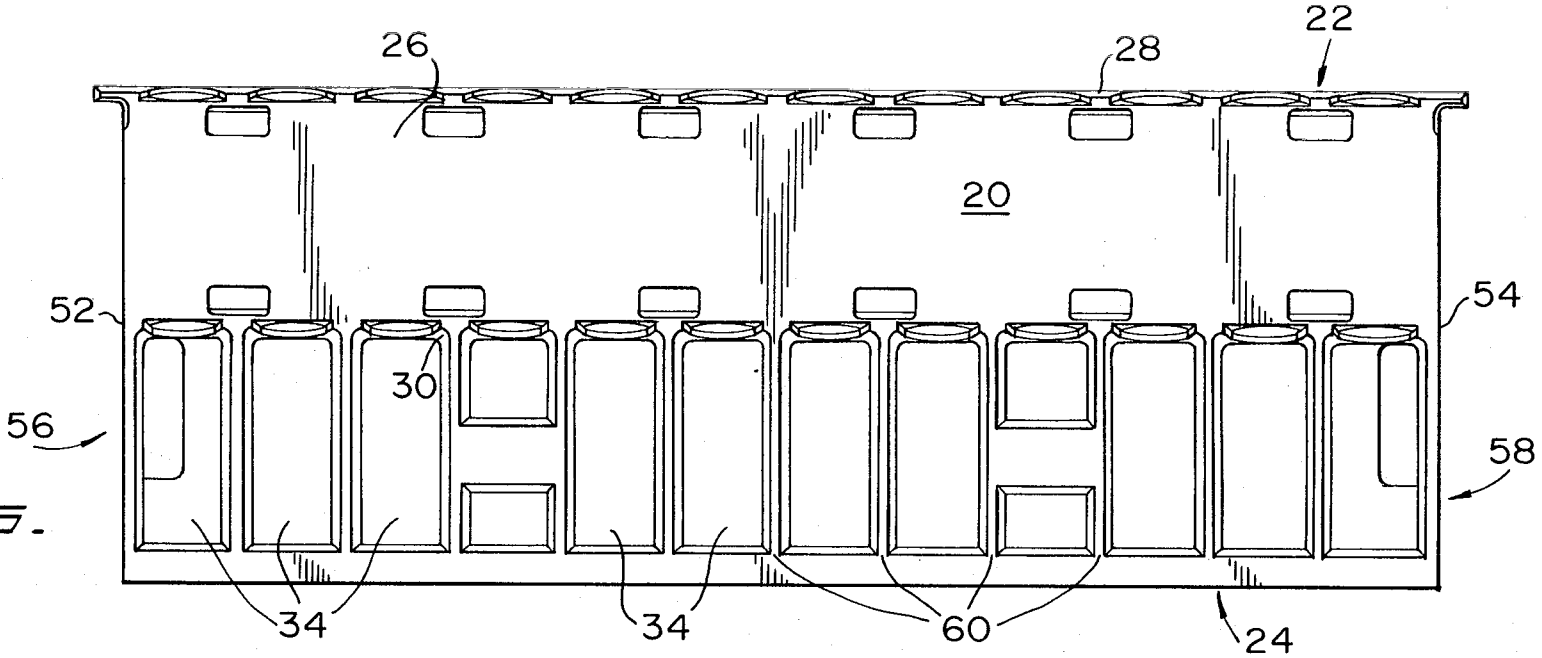
FIG. 5 is a bottom elevation view of the cassette of FIG. 1.

Referring now to the drawings, FIGS. 1–8, a cassette or rack for supporting sealed sample containers or test tubes having different diameters and/or lengths and transporting the same to a testing or sample aspiration station of an analytical or hematology analyzer device, generally indicated by reference numeral 10, is constructed in accordance with the preferred embodiment of the invention. It can securely and properly hold in any position, without their falling out, a number of different size test tubes, for example sample test tubes 12, which have, relatively speaking, a large diameter and long length, together with a number of smaller test tubes 14, which have a smaller diameter and lesser length.

The cassette 10 is generally parallelpiped in shape and comprises a body or frame 16 having a top and bottom, 18 and 20, respectively, and a front and rear portion, 22 and 24, respectively. The body 16 comprises a flat base 26, of rectangular shape disposed at the bottom portion 20 thereof, a front wall member 28, longitudinally extending across the front portion of the base 26, and an intermediate wall member 30 which is spaced away from said rear portion 24 of said body 16 and midway between said front and rear portion, 22 and 24, respectively of said body 16. The intermediate wall member 30 longitudinally extends across the inner portion of said base 26. The body 16 further comprises biasing means 32, of generally rectangular shape, fixedly connected between said front and intermediate wall members 28 and 30, respectively, and further includes a plurality of equidistantly spaced channels or courses 34, best seen in FIG. 7, arranged to permit entry or movement of a rod member 35 (discussed infra) therein or therealong. The front wall member 28 has a plurality of equidistantly spaced circular openings 36 arranged in a row lengthwise of the cassette 10, which openings 36 extend from above the upper wall surface of the base 26 to near the top 18 of the body 16 and have upper and lower edges 38 and 40, respectively. The intermediate wall member 30 also has a plurality of equidistantly spaced circular openings 42, which are of the same diameter as openings 36 and which are also arranged in a row lengthwise of the cassette 10 and which openings 42 also extend from above the upper wall surface of the base 26 to near the top of the body 16 and have upper and lower edges 44 and 46, respectively. Individual ones of the openings 36 and 42 of the front and intermediate wall members, respectively, which are opposed are concentrically aligned with respect to each other and define receptacles 48 for said test tubes each said receptacles 48 having a longitudinal axis 50. The channels or course defining means 34 include rear portions of spaced apart and opposed forward and back end wall portions 52 and 54, respectively, full portions of which define front lateral end portion 56 and back lateral end portion 58 of body 16, and which are transversely connected to the ends of said front and intermediate wall members 28 and 30, respectively. The channels 34 further include a plurality of parallel, transversely extending, rectangularly shaped inner side walls 60, best seen in FIG. 7, connected at their inner ends to the intermediate wall member 30 at points between its openings 42.

Figure 8:
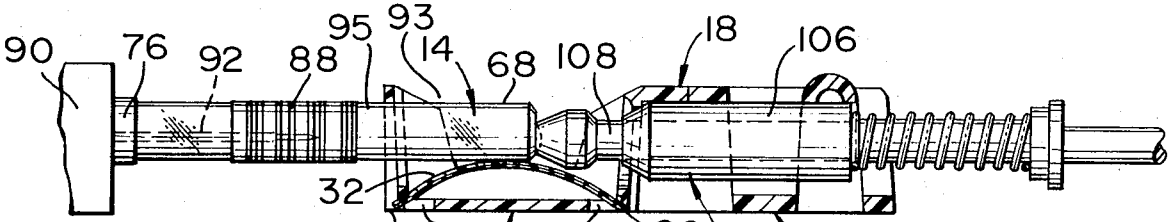
FIG. 8 is a sectional view of the cassette of FIG. 1, taken along the line 8—8 of FIG. 1, and showing the position of the small test tube at an aspiration station with its sampling needle, shown in phantom lines, penetrating within the tube.
Figure 7:
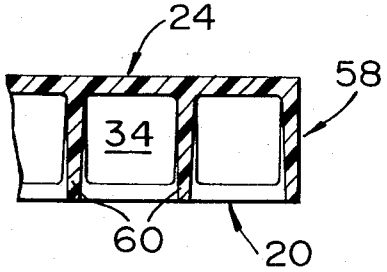
Figure 6:
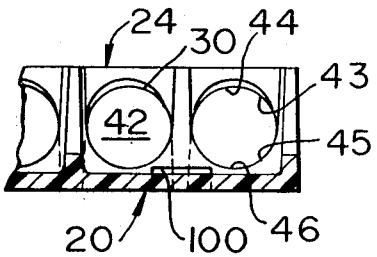
FIG. 6 is a fragmentary sectional view of the cassette of FIG. 1, taken along the line 6—6 of FIG. 1.

Each of the large and small test tubes 12 and 14, respectively, in the cassette 10 have a longitudinal axis 62 and 64, respectively, and a front end or tip 66 and 68, respectively, an open closure end 70 and 72, respectively, which is sealed by a conventional rubber stopper 74 and 76, respectively, having a central depression 78 and 80, respectively, and a shoulder 82 and 84, respectively. Furthermore, each test tube 12 and 14, at its upper end has attached to it by suitable means a conventional optically readable bar code label 86 and 88, respectively, which is wrapped therearound and which includes patient information data and which is readable by a conventional optical reader (not shown) properly positioned thereabove at the time of sampling or aspirating by aspirating means 90, only a front portion of which is shown in FIG. 8 and which includes the forward part of its probe or needle 92. The biasing means 32 are, in the preferred embodiment, formed separately from the rest of the body 16, and each has a width sufficient to provide independent biasing for each of two adjacent test tubes and further includes a first and second tab 94 and 96, respectively, which is snapped within first and second slots 98 and 100, respectively, formed in said body 16 at points where the two spaced wall members 28 and 30 and base 26 abut, as best shown in FIG. 8. Slot 102 formed at its middle and extending along its length provide the independent biasing.

To load the cassette 10 the operator places the desired test tubes containing blood samples within its receptacle 48. All test tubes placed within the receptacles 48 are secured therein, even in their inverted positions, by the biasing members 32, and as best shown in FIG. 4 are moved upwards therein toward the top of the body 16 so that their longitudinal axes 62 and 64 are parallel to the longitudinal axes 50 of their receptacles 48. For example, the longitudinal axis 64 of small diameter test tube 14 is maintained in such position by the center portion of the biasing means 32 and the upper wall surfaces of the test tubes abutting against upper edges 38 and 44 so as to be oriented parallel to the longitudinal axis 50 of its receptacle 48.

In operation after the cassette 10 is filled with test tubes containing blood samples and transported to its aspiration station 90 by, for example, a conveyer mechanism (not shown) which includes an endless belt with a rotating star gear at each of its ends, which gear engages the cassette 10 at the lower edge of its forward end wall portion 52 and the side walls 60, at their rear portions to bring it onto its belt and move it therealong as described in more detail in copending patent application serial number of the same assignee filed concurrently on October 1983, entitled Method and Apparatus for Transporting Carriers of Sealed Sample Tubes and Mixing the Samples, inventors Wallace H. Coulter and William F. Rothermel, a conventional optical test tube detector (not shown) positioned directly above the first receptacle 48 determines if a test tube is present in its receptacle 48 by conventionally directing a beam of light against its upper end at a point thereon just rearwards of the top edge of the front wall member 28. If the optical test tube detector has a narrow depth of field and a test tube of small diameter is secured in the first receptacle 48 such as test tube 14, so that its upper wall surface abuts against at least the upper edge 38 of the front wall member 28, its presence will be detected. Then if a test tube is indicated as being present in the receptacle 48, the co-axial spring pusher mechanism 35 will be actuated. When actuated, it moves forwards into the cassette's channel 34, which lateral wall together with the motion of the outer co-axial tube member 106 of said pusher mechanism 35 will properly align the cassette 10 and its test tubes, so that they are in alignment with the aspirating mechanism 90, all of which have common longitudinal axis. Then its lower tip 68 will be engaged by the front end of an inner rod member 108 of said co-axial spring pusher mechanism 35, only a portion of which is shown, to move the test tube 14 longitudinally toward and into engagement with aspirating mechanism 90, while its bar code label 88 is conventionally read by a conventional, stationary, non-scanning bar code detector (not shown) positioned directly above the first receptacle 48, which bar code detector, can, if desired, be combined with the optical test tube detector. When the stopper 76 of the test tube 14 has traveled sufficiently far so as to engage the aspirating mechanism 90, its sampling needle 92, contained therein, is moved toward the stopper's central depression 80, to perforate it, off center, and to penetrate within the test tube 14 to a predetermined distance therein to aspirate a specific amount of liquid. Only test tubes of the larger diameter size will have their stoppers perforated substantially at their centers.

If desired, optical detection of the bar code labels can be performed while the individual test tubes are stationary within their receptacles 48 by utilizing an optical bar code detector having a narrow depth of field which physically travels over individual test tubes (or just optically scans its bar code label from a stationary position) while still obtaining accurate data therefrom since the longitudinal axes of the test tubes and their receptacles are maintained parallel to one another.

The body 16 of the preferred embodiment of the invention, with the exception of the biasing means 32, is molded in one piece from an appropriate plastic material. Each of the biasing means 32 consist of two separate, identical, members, machined and/or molded from an appropriate plastic material. The preferred embodiment of the cassette 10 is compatable with glass test tubes having an outside diameter ranging from 0.04 inches to 0.49 inches, and a length ranging from approximately 1.6 inches to 3 inches.

It should be understood that this invention is not limited to the specific details of construction and arrangement herein illustrated and/or described and that changes and modifications may occur to one skilled in the art without departing from the spirit and scope of the invention.

We claim:

1. A cassette for supporting in a single row a plurality of liquid sample containers having upper side portions and different diameters and/or lengths and transporting the same to a testing station of an analytical device, comprising:

a body having a top and a bottom and a rear portion, said body including:

a base;

a front wall, longitudinally extending across said base, having a plurality of equidistantly spaced openings arranged in a row lengthwise of the cassette and extending from the base to the top of the body, each of said openings having an upper edge;

an intermediate wall, spaced from said rear portion of said body, longitudinally extending across said base, having a plurality of equidistantly spaced openings arranged in a row lengthwise of the cassette and extending from the base to the top of the body, individual ones of said spaced openings of said front and intermediate wall being in opposed, aligned, spaced apart, relationship;

biasing means, connected to said body and lying between said front and intermediate walls, for positioning the upper edges of all said plurality of sample containers which are disposed within said spaced openings of said front and intermediate walls in the same horizontal plane;

a plurality of equidistantly spaced channels arranged in a row lengthwise of the cassette and extending from the base to the top of the body and from said intermediate wall to the end of the rear portion of said body and open ended thereat and arranged to permit entry of a rod member; and said top portion of said body between said front and intermediate walls defining an unobstructed longitudinal passage extending above the upper side portions of said sample containers.

2. The cassette according to claim 1, wherein the upper portions of said openings of said front and intermediate walls are arc shaped.

3. The cassette according to claim 2, wherein said upper portions of said openings of said front and intermediate walls have the same radius.

4. The cassette according to claim 1, wherein each of said sample containers carries identifying means at their closure end for identifying that container.

5. A cassette for supporting in a single row a plurality of liquid sample containers having upper side portions and longitudinal axes and having different diameters and/or lengths and transporting the same to a testing station of an analytical device, comprising:

a body having a top and a bottom and a rear portion, said body including:

a base;

a front wall, longitudinally extending across said base, having a plurality of equidistantly spaced openings arranged in a row lengthwise of the cassette and extending from the base to the top of the body, each of said openings having an upper edge;

an intermediate wall, spaced from said rear portion of said body, longitudinally extending across said base, having a plurality of equidistantly spaced openings arranged in a row lengthwise of the cassette and extending from the base to the top of the body, each of said openings having an upper edge, individual ones of said spaced openings of said front and intermediate wall being in opposed, aligned, spaced apart, relationship and defining receptacles each having a longitudinal axis;

biasing means, connected to said body and lying between said front and intermediate walls, for maintaining the longitudinal axis of any one of said plurality of sample containers which are disposed within said spaced openings of said front and intermediate walls parallel to the longitudinal axis of its receptacle;

a plurality of equidistantly spaced channels arranged in a row lengthwise of the cassette and extending from the base to the top of the body and from said intermediate wall to the end of the rear portion of said body and open ended thereat and arranged to permit entry of a rod member; and said top portion of said body between said front and intermediate walls defining an unobstructed longitudinal passage extending above the upper side portions of said sample containers.

6. The cassette according to claim 5, wherein the upper portions of said openings of said front and intermediate walls are arc shaped.

7. The cassette according to claim 6, wherein said upper portions of said openings of said front and intermediate walls have the same radius.

8. The cassette according to claim 5, wherein each of said sample containers carries identifying means at their closure end for identifying that container.

9. The cassette according to claim 5, wherein said biasing means directly maintains the longitudinal axes of said sample containers and receptacles parallel to one another.

10. The cassette according to claim 1, wherein said biasing means directly positions said sample containers in the horizontal plane.

11. The cassette according to claim 5, wherein said biasing means maintains the upper edges of said sample containers against the upper edges of said front wall when said rod member has engaged said tip end of said sample container and longitudinally moved it past said spaced opening in said intermediate wall.

12. The cassette according to claim 1, wherein said biasing means maintains the upper edges of said sample containers against the upper edges of said front wall when said rod member has engaged said tip end of said sample container and longitudinally moved it past said spaced opening in said intermediate wall.

13. The cassette according to claim 5, wherein said biasing means positions the upper side portions of all said plurality of sample containers which are disposed within said spaced openings of said front and intermediate walls in the same horizontal plane.

* * * * *